US009078293B2

(12) United States Patent
Wallinger

(10) Patent No.: US 9,078,293 B2
(45) Date of Patent: Jul. 7, 2015

(54) TEMPERATURE DETECTION AND CONTROL SYSTEM FOR LAYERED HEATERS

(71) Applicant: Martin Wallinger, Abtenau (AT)

(72) Inventor: Martin Wallinger, Abtenau (AT)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 157 days.

(21) Appl. No.: 13/779,182

(22) Filed: Feb. 27, 2013

(65) Prior Publication Data

US 2013/0248511 A1 Sep. 26, 2013

Related U.S. Application Data

(60) Provisional application No. 61/603,411, filed on Feb. 27, 2012.

(51) Int. Cl.
*H05B 1/02* (2006.01)
*H05B 3/26* (2006.01)
*H05B 3/20* (2006.01)

(52) U.S. Cl.
CPC ..... *H05B 1/0294* (2013.01); *H05B 3/26* (2013.01)

(58) Field of Classification Search
USPC ..... 219/510, 552–3, 543, 522, 548, 219/469–71, 476–78; 392/438–9; 338/307–9, 292
See application file for complete search history.

(56) References Cited

U.S. PATENT DOCUMENTS 5,886,860 A * 3/1999 Chen et al. ..... 361/9
7,361,869 B2 * 4/2008 Russegger ..... 219/543
2009/0107988 A1 * 4/2009 Kaastra ..... 219/553

FOREIGN PATENT DOCUMENTS

DE 102010016501 9/2011
GB 1117843 * 6/1968

OTHER PUBLICATIONS

International Search Report and Written Opinion of the International Searching Authority for International Appln. No. PCT/US2013/028002 mailed on May 15, 2013.

* cited by examiner

*Primary Examiner* — Shawntina Fuqua
(74) *Attorney, Agent, or Firm* — Brinks Gilson & Lione

(57) ABSTRACT

A system for detecting and controlling temperature of a layered heater is provided that includes a layered heater having in one form a substrate, a first dielectric layer disposed on the substrate, a sensor layer disposed on the first dielectric layer, a second dielectric layer disposed on the sensor layer, a resistive heating layer disposed on the second dielectric layer, and a third dielectric layer disposed on the resistive heating layer. An overtemperature detection circuit is provided in one form that is operatively connected to the resistive heating layer. The circuit includes a resistor, the sensor layer, and an electromechanical relay in parallel with the sensor layer. The sensor layer defines a material having a relatively high TCR and the resistive heating layer defines a material having a relatively low TCR such that a response time of the control system is relatively fast.

24 Claims, 4 Drawing Sheets

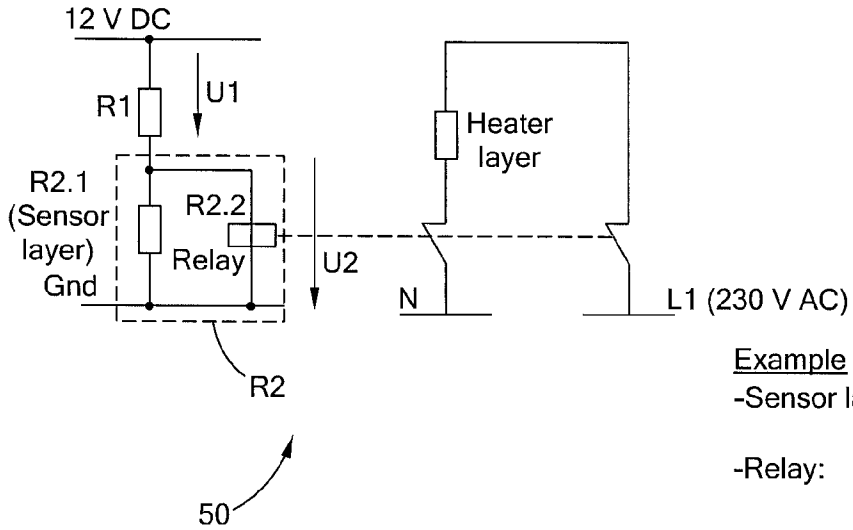

FIG. 2

Example

-Sensor layer:
- TCR: 4500 ppm
- R21 ambient: 50Ω

-Relay:
- Nominal voltage 12 V DC ($V_{total}$)
- Min. switch
  Voltage coil 8.4 V DC (V2)
  (Data sheet relay)
- Rcoil ambient 190Ω ($R_{2.2}$)
  (Data sheet relay)

-Desired Heater cut off temperature: 250°C

---

- $\underline{\underline{R_{2.1}(250°C)}} = R_{2.1}\text{ ambient} \bullet (1+\alpha \bullet \Delta t)$
  $= 50 \bullet (1+ 0.004500 \bullet 230) = \underline{\underline{101.75\Omega}}$

- $R_2 = \frac{R_{2.1} \bullet R_{2.2}}{R_{2.1} + R_{2.2}} = \frac{101.75 \bullet 190}{101.75 + 190} = 66.26\Omega$

- $\frac{V_{total}}{R_{total}} = \frac{V_2}{R_2} \Rightarrow R_{total} = \frac{V_{total} R_2}{V_2} = \frac{12 \bullet 66.26}{8.4} = 94.66\Omega$ $\boxed{R_1} = R_{total} - R_2 = 94.66 - 66.26\Omega = \boxed{28.4\Omega}$

TEMPERATURE DETECTION AND CONTROL SYSTEM FOR LAYERED HEATERS

CROSS-REFERENCE TO RELATED APPLICATIONS

This application claims the benefit of U.S. Provisional Application Ser. No. 61/603,411 filed on Feb. 27, 2012, the contents of which are incorporated herein by reference in their entirety.

FIELD

The present disclosure relates to layered heaters, and in particular, systems for detecting and controlling temperature of layered heaters.

BACKGROUND

The statements in this section merely provide background information related to the present disclosure and may not constitute prior art.

Layered heaters are typically used in applications where space is limited, when heat output needs vary across a surface, or in ultra-clean or aggressive chemical applications. A layered heater generally comprises layers of different materials, namely, a dielectric and a resistive material, which are applied to a substrate. The dielectric material is applied first to the substrate and provides electrical isolation between the substrate and the resistive material and also minimizes current leakage during operation. The resistive material is applied to the dielectric material in a predetermined pattern and provides a resistive heater circuit. The layered heater also includes leads that connect the resistive heater circuit to a heater controller and an over-mold material that protects the lead-to-resistive circuit interface. Accordingly, layered heaters are highly customizable for a variety of heating applications.

Layered heaters may be "thick" film, "thin" film, or "thermally sprayed," among others, wherein the primary difference between these types of layered heaters is the method in which the layers are formed. For example, the layers for thick film heaters are typically formed using processes such as screen printing, decal application, or film printing heads, among others. The layers for thin film heaters are typically formed using deposition processes such as ion plating, sputtering, chemical vapor deposition (CVD), and physical vapor deposition (PVD), among others. Yet another process distinct from thin and thick film techniques is thermal spraying, which may include by way of example flame spraying, plasma spraying, wire arc spraying, and HVOF (High Velocity Oxygen Fuel), among others.

Known systems that employ layered heaters typically include a temperature sensor, which is often a thermocouple or an RTD (resistance temperature detector) that is placed somewhere near the film heater and/or the process in order to provide the controller with temperature feedback for heater control. However, thermocouples and RTDs have a relatively slow response time and often "overshoot" the desired temperature. Thermocouples and RTDs are also limited to only detecting an absolute temperature value and thus provide no other independent control.

Other systems often employ "two-wire" control, in which a resistive heating element functions as both a heater and as a temperature sensor, thus eliminating the need for a separate temperature sensor such as a thermocouple or RTD. However, two-wire control systems can have certain disadvantages, such as TCR characteristics of the heating element causing higher wattage at ambient temperatures versus at a set point temperature. Additionally, a heating cycle with two-wire control can be interrupted by the actual temperature detection, and if a short measurement pulse is used, the temperature of the heater may be undesirably increased.

Certain heater systems also employ over-temperature protection, such as thermal switches or bimetallic switches. These systems can be relatively costly and often have a slow response time. Additionally, temperature detection is only local to the actual switch and thus these systems are somewhat limited in their accuracy.

SUMMARY

In one form of the present disclosure, a system for detecting and controlling temperature of a layered heater. The layered heater comprises a substrate, a first dielectric layer disposed on the substrate, a sensor layer having a sensor termination and disposed on the first dielectric layer, a second dielectric layer disposed on the sensor layer, a resistive heating layer having a heater termination and disposed on the second dielectric layer, and a third dielectric layer disposed on the resistive heating layer. An overtemperature detection circuit is operatively connected to the resistive heating layer and comprises a resistor, the sensor layer, and an electromechanical relay in parallel with the sensor layer. The sensor layer defines a material having a relatively high TCR and the resistive heating layer defines a material having a relatively low TCR such that a response time of the control system is improved.

In another form, a system for detecting and controlling temperature of a layered heater includes a layered heater comprising a substrate, a first dielectric layer disposed on the substrate, a sensor layer disposed on the first dielectric layer, the sensor layer defining a plurality of independently controllable zones, a second dielectric layer disposed on the sensor layer, a resistive heating layer disposed on the second dielectric layer, and a third dielectric layer disposed on the resistive heating layer.

In still another form, a system for detecting and controlling temperature of a layered heater includes a layered heater comprising a substrate, a first dielectric layer disposed on the substrate, a sensor layer disposed on the first dielectric layer, a second dielectric layer disposed on the sensor layer, a resistive heating layer disposed on the second dielectric layer, and a third dielectric layer disposed on the resistive heating layer. The sensor layer defines tracks oriented approximately perpendicular to tracks of the resistive heating layer, the tracks having a width that is narrower than a width of the resistive heating layer tracks and defining a low voltage and low amperage.

In yet other forms, the layered heater includes the sensor layer and resistive heating layer with other features such as the independently controllable zones, the overtemperature protection circuit, and sensor layer tracks. Various other functional layers may also be included, such as the different dielectric layers, or layers such as a graded layer, an EMI (electromagnetic interference) layer, a thermal standoff layer, or even a protective cover such as that disclosed in copending application Ser. No. 12/270,773 titled "Moisture Resistant Layered Sleeve Heater and Method of Manufacturing Thereof," which is commonly assigned with the present application and the contents of which are incorporated by reference herein in their entirety.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 2 is a schematic circuit diagram of an overprotection circuit constructed in accordance with the teachings of the present disclosure and a sample calculation of resistance to set a limit or cut-off temperature;

The drawings described herein are for illustration purposes only and are not intended to limit the scope of the present disclosure in any way.

DETAILED DESCRIPTION

The following description is merely exemplary in nature and is not intended to limit the present disclosure, application, or uses.

As used herein, the term "layered heater" should be construed to include heaters that comprise at least one functional layer (e.g., resistive layer, protective layer, dielectric layer, sensor layer, among others), wherein the layer is formed through application or accumulation of a material to a substrate or another layer using processes associated with thick film, thin film, thermal spraying, or sol-gel, among others. These processes are also referred to as "layered processes" or "layered heater processes."

Figure 1:
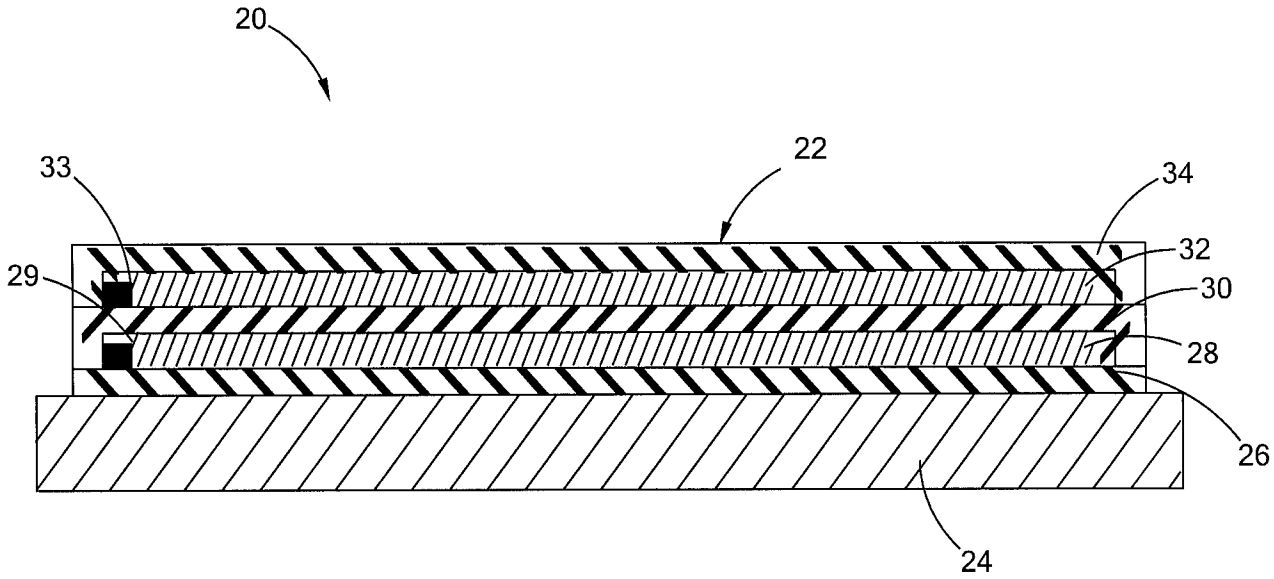
FIG. 1 is a cross-sectional view of a layered heater constructed in accordance with the teachings of the present disclosure.

As shown in FIG. 1, a system for detecting and controlling temperature of a layered heater is illustrated and generally indicated by reference numeral 20. The system 20 comprises a layered heater 22 that includes, in one form, a substrate 24, a first dielectric layer 26 disposed on the substrate 24, a sensor layer 28 disposed on the first dielectric layer 26, a second dielectric layer 30 disposed on the sensor layer 28, a resistive heating layer 32 disposed on the second dielectric layer 30, and a third dielectric layer 34 disposed on the resistive heating layer 32. It should be understood that although the sensor layer 28 is illustrated between the substrate 24 and the resistive heating layer 32, the sensor layer 28 may be disposed on top of the resistive heating layer 32, or in any location with the individual layers, while remaining with the scope of the present disclosure. Additionally, multiple sensor layers 28 may also be employed while remaining within the scope of the present disclosure.

The individual dielectric layers 26, 30, and 34 are generally an electrically insulative material and are provided in a thickness that is commensurate with heat output requirements. Materials for the dielectric layers include but are not limited to those having a resistance of about greater than $1\times10^6$ ohms, such as oxides (e.g., alumina, magnesia, zirconia, and combinations thereof), non-oxide ceramics (e.g., silicon nitride, aluminum nitride, boron carbide, boron nitride), silicate ceramics (e.g., porcelain, steatite, cordierite, mullite).

The sensor layer 28 defines a material having a TCR (temperature coefficient of resistance) from a relatively low value such as 500 ppm/° C. to a relatively high value such as 10,000 ppm/° C. For more accurate temperature detection, the higher value TCR is used. It should also be understood that materials with a negative TCR, such as graphite by way of example, may also be used in accordance with the teachings of the present disclosure. Such TCR values range from about −500 ppm/° C. to about −10,000 ppm/° C. The sensor layer 28 includes a sensor termination 29 that is connected to the resistive heating layer 32, which also includes a termination 33 as shown.

The resistive heating layer 32 is comprised of a material that has a relatively low or even negative TCR such as −10,000 ppm/° C. to about 1 ppm/° C. to a relatively high TCR such as 1 ppm/° C. to about 10,000 ppm/° C. according the application requirements. In many forms, a relatively low TCR value is preferred with the relatively high TCR value for the sensor layer 28 as set forth above. Since the resistive heating layer 32 is a separate layer from the sensor layer 28, a variety of different layouts (e.g., trace geometry, width, thickness) for the resistive heating layer 32 can be used independent from the layout of the sensor layer 28, which is not possible with two-wire control systems. In addition to the layouts, different materials can be selected for each of the sensor layer 28 and the resistive heating layer 32, thus providing additional design flexibility in the overall system 10.

With this layered heater construction and the ability to tailor each of the layers and their materials, the system 10 can have a quick response time, such as less than about 5 seconds and more specifically less than about 500 milliseconds. Additionally, temperature detection can be across the entire layer or in discrete locations by tailoring the design of the sensor layer 28. Moreover, as opposed to two-wire control systems, a heating cycle is not influenced by measurement pulses, and thus a more responsive system is provided by the teachings of the present disclosure.

Although three dielectric layers, a single resistive heating element layer, and a single sensor layer are illustrated, it should be understood that any number of layers, combinations of layers, and arrangement of layers may be employed while remaining within the scope of the present disclosure. For example, multiple resistive heating layers and/or sensor layers may be employed, the resistive and/or sensor layer may be directly disposed on a substrate or part to be heated, and other functional layers such as a graded layer, adhesvie layer (s), or EMI layer may be employed, among other variations.

Referring now to FIG. 2, an overtemperature detection circuit 50 is provided, which is operatively connected to the resistive heating layer 32. The overtemperature detection circuit 50 is generally a divider circuit that comprises a resistor R1 (or alternatively a potentiometer for variable adjustment of the switch of temperature), the sensor layer 28 (R2.1), and an electromechanical relay R2.2 in parallel with the sensor layer R2.1. With this circuit 50, the limit or cut-off temperature can adjusted by setting the value of R1. An exemplary calculation of R1 being about 30 ohms is shown in FIG. 2 for a cut-off temperature of 250° C. It should be understood that this calculation and the specific circuit components are merely exemplary and should not be construed as limiting the scope of the present disclosure. With this overtemperature detection circuit 50, the need for software is eliminated, although software may still be employed while remaining within the scope of the present disclosure. Additionally, the overtemperature detection circuit 50 can function as a thermal cut-off, or as a thermal switch.

Figure 3:
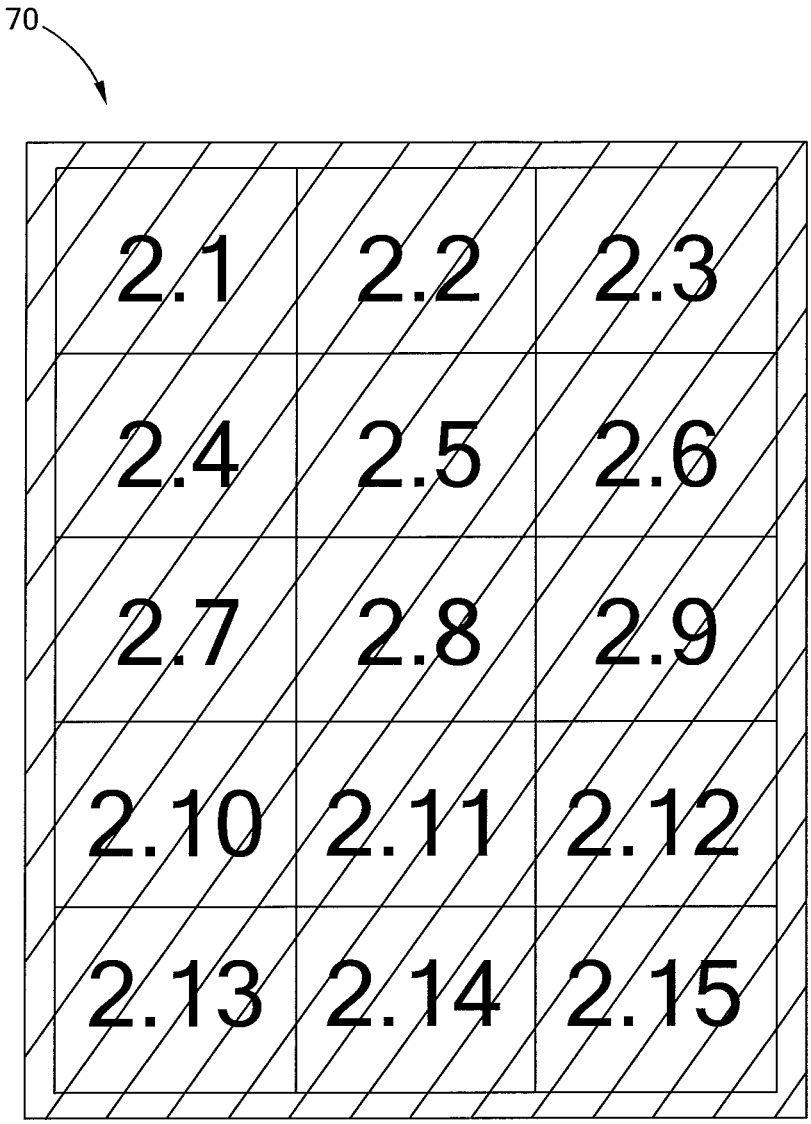
FIG. 3 is top plan view of a sensor layer having independently controllable zones and constructed in accordance with the teachings of the present disclosure.

Referring now to FIG. 3, another form of the sensor layer is illustrated and generally indicated by reference numeral 70. The sensor layer 70 comprises a plurality of independently controllable zones as shown, 2.1, 2.2, 2.3, . . . 2.15. In this exemplary embodiment, a 3×5 grid of zones results in 15 independently controllable zones. It should be understood that any size grid and number of zones may be employed in accordance with the teachings of the present disclosure. It should also be understood that different sizes of zones may be used rather than the uniform sizes as illustrated. Also, the zones may be constructed of the same material, or they may be constructed of different materials from zone to zone. For example, the materials may include, Nickel, Copper, and alloys thereof, Aluminum alloys, Tungsten, or Platinum, among others.

As "independently controllable zones," these elements include a separate set of terminal leads (not shown), or the leads may be combined to activate individual rows and/or columns in order to reduce the complexity of the electrical connections. With this increased level of fidelity in the sensor layer 70, the overall system can be more responsive to a local over-temperature condition, or other unexpected operating conditions.

Figure 4:
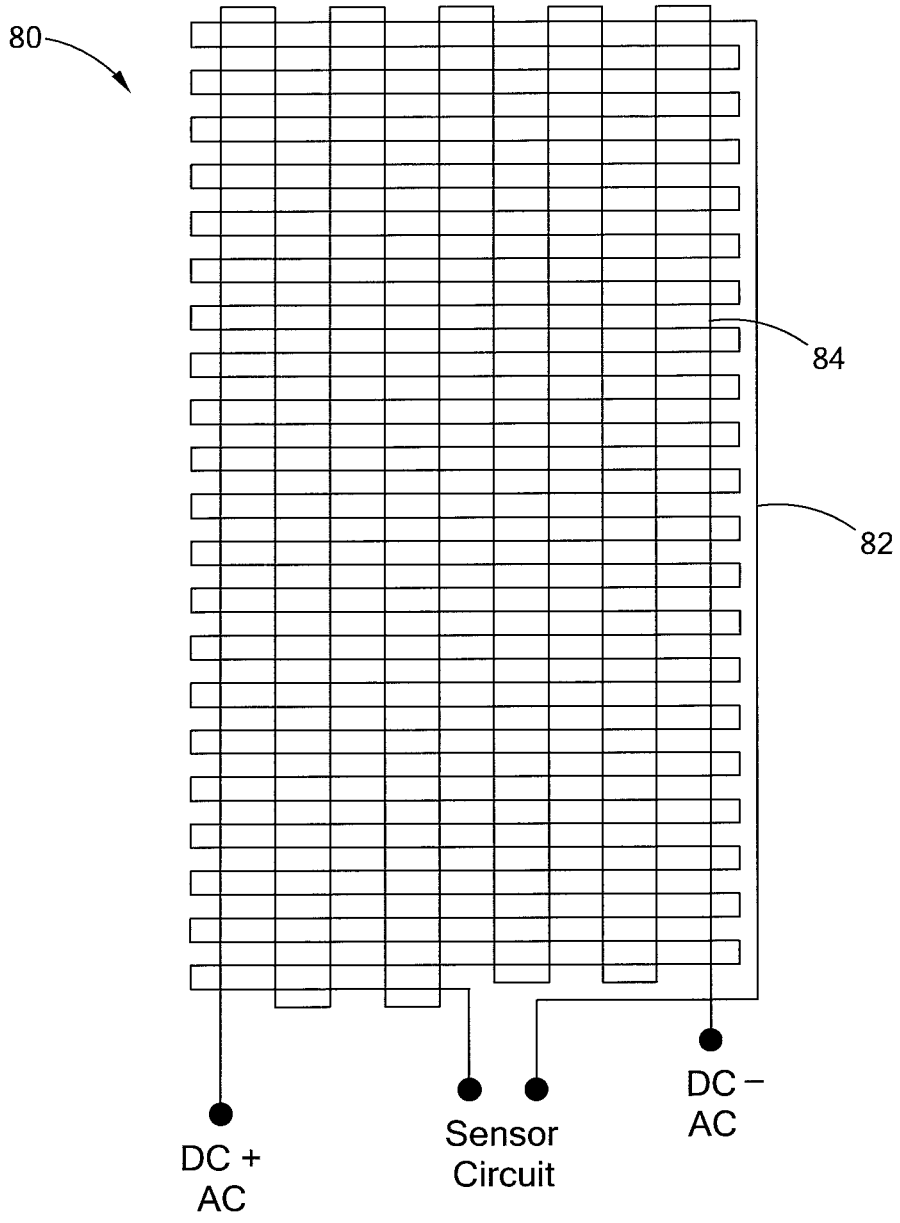
FIG. 4 is a top plan view of a sensor layer having tracks that are used to protect the resistive heating layer from inadvertent electrical arcs.

Referring to FIG. 4, yet another form of a sensor layer is illustrated and generally indicated by reference numeral 80. In this form, the sensor layer 80 defines tracks 82 that are oriented approximately perpendicular to tracks 84 of the resistive heating layer 32. The tracks 82 of the sensor layer 80 have a width $W_s$ that is narrower than a width $W_r$ of the resistive heating layer tracks 84. The sensor layer tracks 82 are also low voltage and low amperage, for example, 12V DC and 100 mA. Accordingly, this form of the present disclosure is designed to detect cracks in one of the layers, for example, in one of the dielectric layers or the resistive heating layer. If a crack occurs in one of the layers, power being supplied to the resistive heating layer could arc and damage the surrounding layers and possibly become a safety issue. The sensor layer tracks 82 are designed to detect such cracks and prevent an inadvertent electrical arc from occurring by switching off power to the resistive heating layer 32. As long as the sensor layer tracks 82 cross the resistive heating layer tracks 84, such detection occurs. Accordingly, the tracks do not necessarily have to be perpendicular to one another, and thus the illustration included herein is merely exemplary. In one exemplary form, the sensor layer tracks 82 have a width $W_s$ of about 1 mm while the resistive heating layer tracks 84 have a width of $W_r$ of about 5 mm, with voltages and amperages of about 230 VAC and 10 A respectively.

In the various forms illustrated and described herein, the layers are formed by a thermal spray process and the resistive heating layers and sensor layers are formed by a laser removal process, which are described in greater detail in U.S. Pat. No. 7,361,869, which is commonly assigned with the present application and the contents of which are incorporated herein in their entirety. It should be understood, however, that other layered processes as set forth above may be used for one or more of the layers and that other methods to generate the traces can be used such as masking or water jet, among others.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A system for detecting and controlling temperature of a layered heater comprising:

a layered heater comprising:

a substrate;

a first dielectric layer disposed on the substrate;

a sensor layer having a sensor termination and disposed on the first dielectric layer;

a second dielectric layer disposed on the sensor layer;

a resistive heating layer having a heater termination and disposed on the second dielectric layer; and a third dielectric layer disposed on the resistive heating layer; and an over temperature detection circuit operatively connected to the resistive heating layer comprising:

a resistor;

the sensor layer; and an electromechanical relay in parallel with the sensor layer, wherein the sensor layer defines a material having a relatively high TCR and the resistive heating layer defines a material having a relatively low TCR such that a response time of the control system is less than about 1 second.

2. The system according to claim 1, wherein the sensor layer defines a plurality of independently controllable zones.

3. The system according to claim 2, wherein the independently controllable zones define the same size and the same material.

4. The system according to claim 2, wherein the plurality of independently controllable zones of the sensor layer define different materials.

5. The system according to claim 1, wherein the resistive heating layer further defines a track, wherein the resistive heating layer is formed by a thermal spray process and the track is formed by a laser removal process.

6. The system according to claim 1, wherein the sensor layer defines tracks oriented approximately perpendicular to tracks of the resistive heating layer, the tracks having a width that is narrower than a width of the resistive heating layer tracks and defining a voltage from about zero to about 48 V DC/AC and an amperage from about zero to about 1 amp.

7. The system according to claim 6, wherein the sensor tracks and the resistive heating layer tracks are formed by a laser removal process.

8. The system according to claim 6, wherein the sensor layer tracks are oriented approximately perpendicular to tracks of the resistive heating layer, the tracks of the sensor layer having a width that is narrower than a width of the resistive heating layer tracks and defining a voltage from about zero to about 48 V DC/AC and an amperage from about zero to about 1 amp.

9. The system according to claim 1, wherein the over temperature detection circuit functions as a thermal cut-off or as a thermal switch.

10. The system according to claim 2, wherein the sensor layer comprises one selected from the group consisting of Nickel, Copper, Nickel alloys, Copper alloys, Aluminum alloys, Tungsten, and Platinum.

11. The system according to claim 1, wherein the first, second, and third dielectric layers exhibit a resistance that is $1 \times 10^6$ ohms or greater.

12. The system according to claim 11, wherein the first, second, and third dielectric layers independently comprise one selected from the group consisting of alumina, magnesia, zirconia, silicon nitride, aluminum nitride, boron carbide, boron nitride, porcelain, steatite, cordierite, and mullite.

13. The system according to claim 1, wherein the sensor layer defines a material having a TCR of about 10,000 ppm/° C. and the resistive heating layer defines a material having a TCR ranging from −10,000 ppm/° C. to about 1 ppm/° C.

14. A system for detecting and controlling temperature of a layered heater comprising:

a layered heater comprising:

a substrate;

a first dielectric layer disposed on the substrate;

a sensor layer having a sensor termination and disposed on the first dielectric layer the sensor layer comprising tracks of width $W_s$ and formed of a material having a relatively high temperature coefficient of resistance (TCR);

a second dielectric layer disposed on the sensor layer;

a resistive heating layer having a heater termination and disposed on the second dielectric layer, the resistive heating layer comprising tracks of width $W_r$ and formed of a material having a relatively low TCR; and a third dielectric layer disposed on the resistive heating layer; and an over temperature detection circuit operatively connected to the resistive heating layer comprising: a resistor or potentiometer; the sensor layer; and an electromechanical relay in parallel with the sensor layer;

wherein $W_r$ is greater than $W_s$ and the sensor layer tracks cross the resistive heating layer tracks.

15. The system according to claim 14, wherein $W_s$ is about 1 mm and $W_r$ is about 5 mm.

16. The system according to claim 14, wherein the sensor layer tracks are oriented approximately perpendicular to the resistive heating layer tracks.

17. The system according to claim 15, wherein the sensor layer tracks exhibit a voltage of about 12 V and an amperage of about 100 mA and the resistive heating layer tracks exhibit a voltage of about 230 VAC and an amperage of about 10 A.

18. The system according to claim 14, wherein the first, second, and third dielectric layers exhibit a resistance that is $1 \times 10^6$ ohms or greater.

19. The system according to claim 14, wherein the over temperature detection circuit functions as a thermal cut-off or as a thermal switch.

20. The system according to claim 14, wherein the sensor layer defines a material having a TCR of about 10,000 ppm/° C. and the resistive heating layer defines a material having a TCR ranging from −10,000 ppm/° C. to about 1 ppm/° C.

21. The system according to claim 14, wherein the sensor layer defines a plurality of independently controllable zones.

22. The system according to claim 21, wherein the independently controllable zones define the same size and the same material.

23. The system according to claim 21, wherein the plurality of independently controllable zones of the sensor layer define different materials.

24. A system for detecting and controlling temperature of a layered heater comprising:

a layered heater comprising:

a substrate;

a first dielectric layer disposed on the substrate;

a sensor layer having a sensor termination and disposed on the first dielectric layer, such that the sensor layer defines a plurality of independently controllable zones, the sensor layer comprising tracks of width $W_s$ and formed of a material having a temperature coefficient of resistance (TCR) of about 10,000 ppm/° Cl;

a second dielectric layer disposed on the sensor layer;

a resistive heating layer having a heater termination and disposed on the second dielectric layer, the resistive heating layer comprising tracks of width $W_r$ and formed of a material having a TCR ranging from −10,000 ppm/° C. to about 1 ppm/° C.; and a third dielectric layer disposed on the resistive heating layer; and an over temperature detection circuit operatively connected to the resistive heating layer comprising: a resistor or potentiometer; the sensor layer; and an electromechanical relay in parallel with the sensor layer;

wherein $W_r$ is greater than $W_s$ and the sensor layer tracks cross the resistive heating layer tracks and are oriented approximately perpendicular thereto.

* * * * *